US006076344A

United States Patent [19]

Doujak

[11] Patent Number: 6,076,344

[45] Date of Patent: Jun. 20, 2000

[54] PROCESS FOR PRODUCING A STEEL CORD

[75] Inventor: Siegfried Doujak, Merzig, Germany

[73] Assignee: Drahtcord Saar GmbH & Co. KG, Merzig, Germany

[21] Appl. No.: 09/043,500

[22] PCT Filed: Sep. 4, 1996

[86] PCT No.: PCT/EP96/03884

§ 371 Date: Jul. 17, 1998

§ 102(e) Date: Jul. 17, 1998

[87] PCT Pub. No.: WO97/12091

PCT Pub. Date: Apr. 3, 1997

[30] Foreign Application Priority Data

Sep. 25, 1995 [DE] Germany ..... 195 35 598

[51] Int. Cl.[7] ..... D02G 3/36

[52] U.S. Cl. ..... 57/9; 57/10; 57/13; 57/17; 57/212; 57/236; 57/237; 57/902

[58] Field of Search ..... 57/902, 9, 10, 57/12, 13, 17, 18, 311, 212, 213, 236, 237

[56] References Cited

U.S. PATENT DOCUMENTS

| | | | |
|---|---|---|---|
| 3,977,174 | 8/1976 | Boileau | 57/145 |
| 4,022,009 | 5/1977 | Van Assendelft | 57/145 |
| 4,030,248 | 6/1977 | Van Assendelft | 57/9 |
| 4,158,946 | 6/1979 | Bourgois | 57/213 |
| 4,545,190 | 10/1985 | Rye et al. | 57/212 |
| 4,651,513 | 3/1987 | Dambre | 57/217 |
| 4,724,663 | 2/1988 | Bourgois et al. | 57/15 |
| 4,938,015 | 7/1990 | Kinoshita | 57/200 |
| 5,162,067 | 11/1992 | Miyawaki | 152/451 |
| 5,198,307 | 3/1993 | Bourgois et al. | 428/589 |
| 5,323,596 | 6/1994 | Nguyen | 57/214 |
| 5,581,990 | 12/1996 | Van Giel et al. | 57/311 |
| 5,797,257 | 8/1998 | Cipparrone et al. | 57/902 |

FOREIGN PATENT DOCUMENTS

| | | |
|---|---|---|
| 0363893 | 4/1990 | European Pat. Off. . |
| 0492682 | 7/1992 | European Pat. Off. . |
| 2619086 | 11/1976 | Germany . |
| 3635298 | 4/1988 | Germany . |

*Primary Examiner*—William Stryjewski
*Attorney, Agent, or Firm*—Stevens, Davis, Miller & Mosher, LLP

[57] ABSTRACT

Process for producing a steel cord for pneumatic tires comprising a bunch of wires, the core of which consists of wire filaments 10 arranged bunched juxtaposed in parallel. Preferably at least three wire filaments 10, 20 are provided, at least two wire filaments located juxtaposed in parallel being spirally shaped as core filaments 10 forming a core 60 and at least one wire filament spirally surrounding the two core filaments 10 as a sheathing wire 20. Spirally shaping the wire filaments 10 is achieved in accordance with the invention by false twisters 40. Due to this spiral shaping of the wire filaments 10 migration of the filaments from the core composite is avoided more particularly. The residual torsional stresses of the core filaments among each other and in conjunction with the restoring forces of the sheathing wire are advantageously cancelled. In addition, the steel cord features to advantage a flattened, more particularly, oval shape.

20 Claims, 3 Drawing Sheets

PROCESS FOR PRODUCING A STEEL CORD

FIELD OF THE INVENTION

The invention relates to a process for producing a steel cord as well as to a steel cord produced by this process.

BACKGROUND OF THE INVENTION

Steel cords as inserts in vehicular pneumatic tires for improving ride, dynamics, stability and extending useful life are known and are typically made up of strands, a strand being a bunch of at least two, as a rule, however, typically more, individual wires interlaid and/or intertwined, produced by means of a stranding machine in a highly complicated procedure.

Furthermore, steel cords are known, the core of which consists of a central, compartmented bunch of wires which are no longer produced in a separate stranding process but can be formed directly in stranding.

Known from DE 39 14 330 C2 is a process for twisting and also overtwisting strands in producing steel wires to attain a desired residual torsion. Such residual torsions represent an important feature in the finished steel cord since they mainly dictate the flat location of a rubberized steel cord web. In addition to this the residual torsions are also responsible for the uniformity of the cut edges of the cord sections.

Known from EP 0 492 682 A1 is a bunch of wires for a tire cord comprising two to seven individual filaments having substantially a circular cross-section. The individual filaments are oriented juxtaposed in parallel in a single plane and are sheathed by one or more filaments in a single sheathing direction. One or more of the core filaments arranged in one plane or the plane of the core filaments as a whole features residual torsional stresses. Said elastic residual torsional stresses are selected such that the bunch of wires remains substantially flat full-length as long as it is not subjected to external forces. The magnitude and direction of the residual torsional stresses are selected so that the elastic residual torsional stresses of the core filaments are cancelled by the restoring forces of the sheathing filaments.

Known from DE-A 26 19 086 is a reinforcement cord for elastomer products consisting of spirally shaped wires, one or more of the individual steel sheathing wires being wound about a core which is in turn made up of two or more individual steel wires which are not intertwined. In this arrangement the core wires have the same spiral-shaped configuration and are arranged adjacent and opposite to each other so that each of the core wires is linearly in contact with at least one other core wire. In the known reinforcement cord the spiral of the sheathing wires features the same hand and pitch as that of the core wires. The known reinforcement cord is produced by combining the wires into a bunch of core wires. The bunch is guided over a first downsweep edge and each of one or more wires is guided over one or several downsweep edges and twisted around the bunch. The radius of curvature of the downsweep edges dictates the radius of curvature of the wires.

In twisting and preshaping the individual filaments care must be taken that their fatigue strength is not impaired by the treatment. More particularly, when shaped via gearwheels and the like the high-strength individual filaments receive localized points of compression as a result of which they are unsuitable for cyclic stressing since such localized deformations are the starting points for the occurrence of fatigue fractures.

SUMMARY OF THE INVENTION

The present invention is thus based on the object of providing a process for producing a steel cord including a bunch of wires as the core which can be simply implemented technically and resulting in a steel cord of improved quality as regards strength, fatigue properties and working ability. More particularly the process in accordance with the invention is intended to permit achieving smaller radii of curvature than those of known processes.

Also, more particularly, the invention is based on the object of proposing a process for producing a steel cord in which no impairment of the wire coating or localized pressure points occur.

To achieve the object forming the basis of the invention a process for producing a steel cord is proposed which comprises the following steps:

A: uncoiling from reels at least two wire filaments serving as core filaments,

B: combining the uncoiled core filaments into a strand and

C: twisting the uncoiled core filaments in a false twister,

D: uncoiling from a reel at least one wire filament serving as the sheathing wire and E: winding the sheathing wire around the core filaments spirally preformed into a core.

More particularly, the present invention includes a process of producing a steel cord comprising the following steps:

A: uncoiling from reels at least two wire filaments serving as core filaments,

B: combining said uncoiled core filaments in a false twister into a strand and initially intertwining the core filaments to spirally preshape them, and C: sheathing said spirally preshaped individual filaments located downstream of said false twister juxtaposed in parallel in the form of a core with at least one wire filament servicing as the sheathing wire uncoiled from a reel.

In the process in accordance with the invention the core filaments are intertwined by means of a false twister to obtain a spiral plastic deformation. Downstream of the false twister the spirally preshaped individual filaments located juxtaposed in parallel are wrapped by at least one sheathing wire. The substantial advantage of the production process in accordance with the invention lies in the gentle plastic deformation of the core filaments by means of a false twister, resulting neither in impairment of the coating nor in localized pressure points. Accordingly, the steel cord produced by the process in accordance with the invention features good bonding to the tire rubber and, in addition, high fatigue strength.

In a further aspect of the production process in accordance with the invention it is proposed that in step B, of the process more particularly described above, two, three or four core filaments are mutually intertwined and that two or more strands are combined with two, three or four intertwined core filaments into a core in an additional step C.

The process as proposed in accordance with the invention ensures a simple and cost-effective means of producing a steel cord in accordance with the invention since no additional bunching and/or stranding procedures are needed outside of the production line, i.e. the complete steel cord being instead produced in accordance with the invention so-to-speak in one piece in the production line. The nature in which the steel cord is preshaped also prevents the wire filaments from being damaged and/or locally deformed as may be the case, for example, in preshaping by means of gearwheels. Accordingly, the nature of production in accordance with the invention is without detriment to the fatigue properties of the steel cord. In addition to this steel cords in accordance with the invention are achievable with smaller radii of curvature. The steel cord in accordance with the invention is thus producible by a single type of machine, merely minor modifications being necessary to the machine in producing various types of cord.

The process in accordance with the invention is also suitable for producing steel cords having cores of spirally preshaped core filaments which in addition feature residual torsional stresses which are cancelled outwardly by suitably selecting the sheathing with a sheathing wire.

In further achieving the object of the invention a steel cord having a bunch of wires is proposed which comprises at least three wire filaments, at least two filaments being spirally shaped to form a core and oriented juxtaposed in parallel and at least one wire filament surrounding the two core filaments spirally as the sheathing wire. In its simplest form a bunch of wires in accordance with the invention for a steel cord thus comprises three filaments, two of which are spirally shaped and surrounded likewise spirally by the third filament. Thus, the two spiral shaped core filaments are surrounded by a likewise spiral shaped sheathing wire. The individual filaments are suitably intertwined by means of a false twister with the desired number of revolutions to then be returned together downstream of the false twister in parallel to each other but with a spiral preshaping. A further filament having the same pitch and hand as the spiral preshape of the individual filaments is then wrapped around this bunch of parallel individual filaments. Due to this configuration of the wire bunch in accordance with the invention the individual filaments are neither damaged nor locally deformed so that a steel cord produced with such a bunch of wires features very good fatigue properties for a tire, especially in the case of compressive strain.

In one advantageous aspect of the invention one or more plies of sheathing wires are provided surrounding the at least two core filaments, as a result of which a bunch of wires for a tire cord is provided in which the wires of the core bunch do not migrate from the cord composite even when put to use in the belt of the tire. The bunch of wires in accordance with the invention can be produced highly cost-effectively since the core bunch necessitates no separate operation, it instead being produced in line with the production as a whole.

In a further achievement of an embodiment of the present invention from claim a steel cord having a bunch of wires is proposed, in which at least two wire filaments are oriented bunched juxtaposed in parallel as core filaments forming a core and featuring residual torsional stresses which in conjunction with the restoring forces of at least one the sheathing wires surrounding the core filaments are cancelled out. The bunch of wires in accordance with the invention can be simply produced since the wire filaments of the core are not located parallel to each other in a single plane, which involves a certain complication technically in production, they instead being combined in the form of a bunch. By suitably selecting the elastic residual torsional stresses simple means of working the rubberizing are achieved since the bunch of wires in accordance with the invention remains located flat during rubberizing.

In a further advantageous aspect of the invention the steel cord is compressed such that if features a flattened, substantially oval shape. This oval shape in accordance with the invention has considerable advantages for application in tires, more particularly due to the stiffness of the steel cord differing radially and laterally. The flattened, substantially oval shape can be achieved, for example, by squeezing the steel cord between a pair of rolls.

Further advantageous aspects of the invention and of the process in accordance with the invention read from the sub-claims.

BRIEF DESCRIPTION OF THE DRAWINGS

The invention will now be discussed in more detail on the basis of several example embodiments with respect to the drawing, in which.

DETAILED DESCRIPTION OF THE PREFERRED EMBODIMENTS

Figure 3:
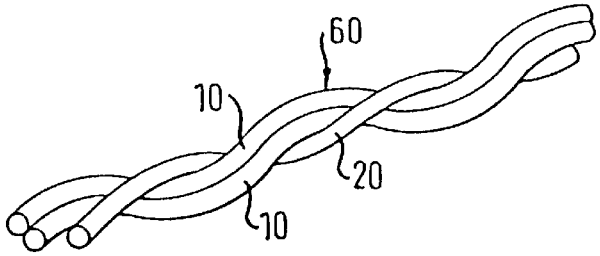
FIG. 3 is a schematic perspective illustration of a steel cord in accordance with the invention comprising two spirally preshaped core filaments located juxtaposed in parallel, surrounded spirally by a sheathing wire.

FIGS. 3 to 6 illustrate various embodiments of steel cords in accordance with the invention each having a differing number of wire filaments forming the core of the steel cord. Illustrated in FIG. 3 is a first embodiment of a steel cord in accordance with the invention incorporating a bunch of wires with two core filaments 10 as the core 60 which are spirally shaped and oriented juxtaposed in parallel. The two core filaments 10 are surrounded by a further filament as the sheathing wire 20, this sheathing wire 20 being located with the same pitch and hand as the spiral shape of the core filaments 10. In the example embodiment shown the core filaments 10 are shaped left-handedly and the sheathing wire 20 is likewise wound left-handedly about the two core filaments 10. For such a steel cord the pitch is typically approximately 14 mm, the diameter of the core filaments 10 and of the sheathing wire 20 is approximately 0.28 mm.

Figure 4:
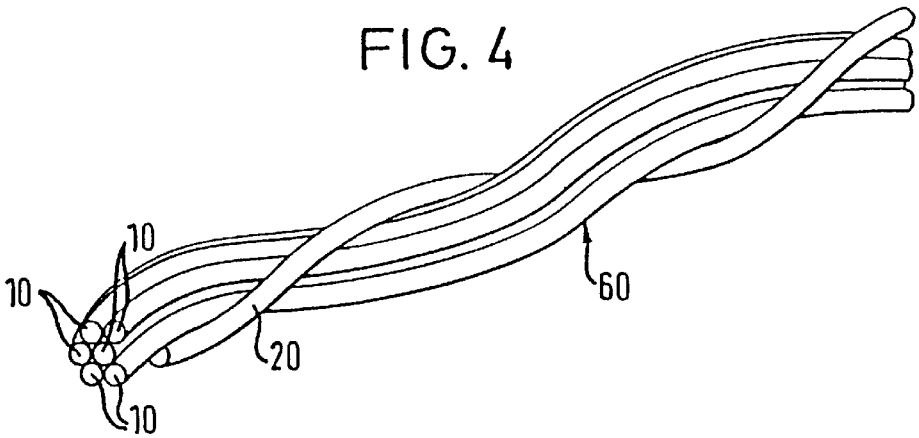
FIG. 4 is an illustration of a steel cord as shown in FIG. 3 in accordance with the invention but comprising six spirally preshaped core filaments located juxtaposed in parallel.

Referring now to FIG. 4 there is illustrated a different embodiment of a steel cord in accordance with the invention as shown in FIG. 3 in which the core 60 is formed from six spirally shaped core filaments 10 located juxtaposed in parallel, the spiral being shaped left-handedly and surrounded by a left-handed seventh filament as the sheathing wire 20 . In this example embodiment the pitch may be, for example, 18 mm and the diameter of the filaments used may be 0.35 mm.

It will readily be appreciated, of course, that steel cords are also conceivable having wire bunches comprising an even greater number of wire filaments. With an increasing number of wire filaments in the core the diameter of the filaments is selected smaller. Depending on the requirements the pitch can be defined and the diameter of the sheathing wire can be selected the same as the diameter of the wire filaments of the core, but may also differ from their diameter. In the case of a core wire bunch formed of twelve spirally shaped wire filaments the pitch is e.g. advantageously 12.5 mm, the diameter of the wire filaments 0.22 mm and the diameter of the sheathing wire surrounding the core wire bunch 0.15 mm.

Figure 5:
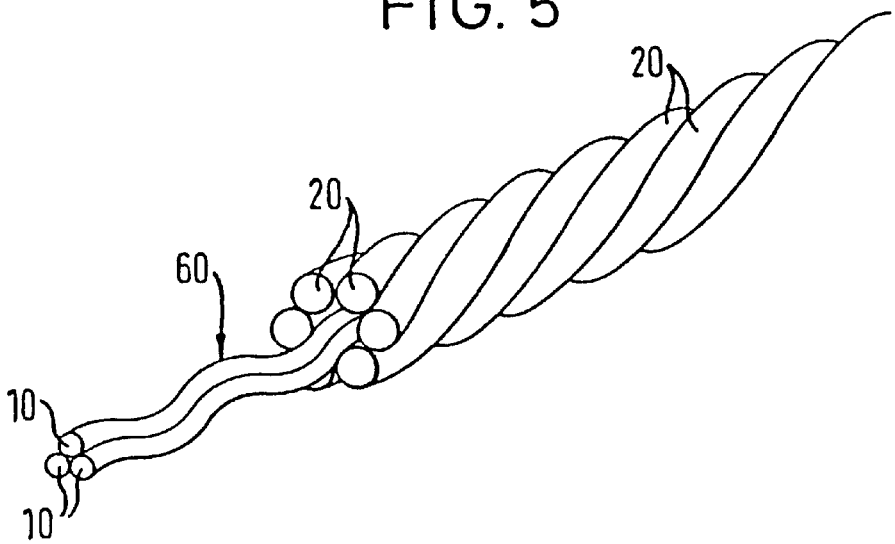
FIG. 5 is a schematic perspective illustration of a steel cord in accordance with the invention comprising three spirally preshaped core filaments as the core located juxtaposed in parallel, surrounded by a ply of six sheathing wires

Referring now to FIG. 5 there is illustrated schematically in perspective a further example embodiment of a steel cord in accordance with the invention. The core 60 of the steel cord is formed by three spirally preshaped core filaments 10 located juxtaposed in parallel. These are surrounded by a ply of six sheathing wires 20 located closely juxtaposed having the same hand as the core filaments 10. For a better appreciation the core filaments 10 are depicted longer than the sheathing wires 20. The hand of the core filaments 10 may also be opposite to the hand of the sheathing wires 20, however.

Such a close sheathing of the core 60 with a ply of sheathing wires 20 has the advantage that the core filaments 10 of the core bunch cannot migrate from the core composite even when put to use as the steel belt. In addition, producing such a steel cord is highly cost-effective since the core bunch 60, as will be described in the following, necessitates no separate operation, it instead being able to be produced in line with the steel cord production.

In the case of the example embodiment as shown in FIG. 5 the core filaments 10 feature to advantage a diameter of 0.2 mm, the sheathing wires 20 a diameter of 0.35 mm.

Figure 6:
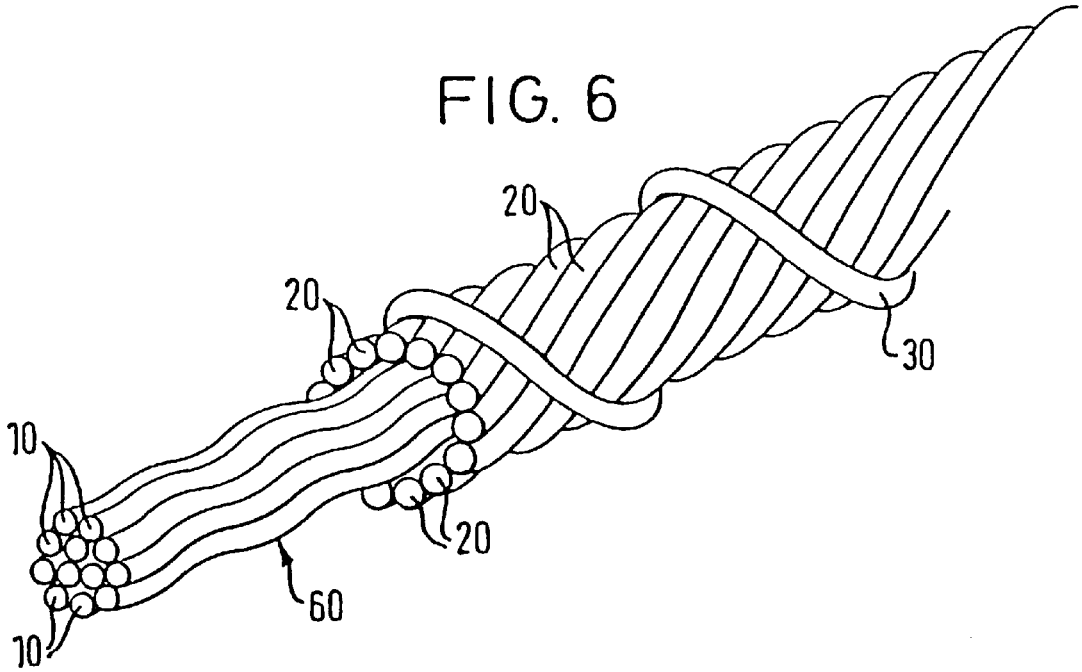
FIG. 6 is an illustration of a further steel cord in accordance with the invention comprising a core of twelve spirally preshaped wire filaments surrounded by a ply of sheathing wire s which in turn are surrounded spirally by a spiral wire.

Referring now to FIG. 6 there is illustrated an example embodiment of a steel cord in accordance with the invention similar to that as shown in FIG. 5, it incorporating a core 60 of twelve left-handed spirally preshaped core filaments 10 which in turn are surrounded by a left-handed ply of fifteen sheathing wires 20. In this example embodiment all wires have to advantage the same diameter of 0.175 mm. The steel cord as shown in FIG. 6 is additionally wrapped right-handedly by a spiral wire 30. The diameter of the spiral wire 30 is, for example, 0.15 mm. In this example embodiment too, the hand of the core filaments 10 may be opposite to the hand of the sheathing wires, of course.

Figure 1:
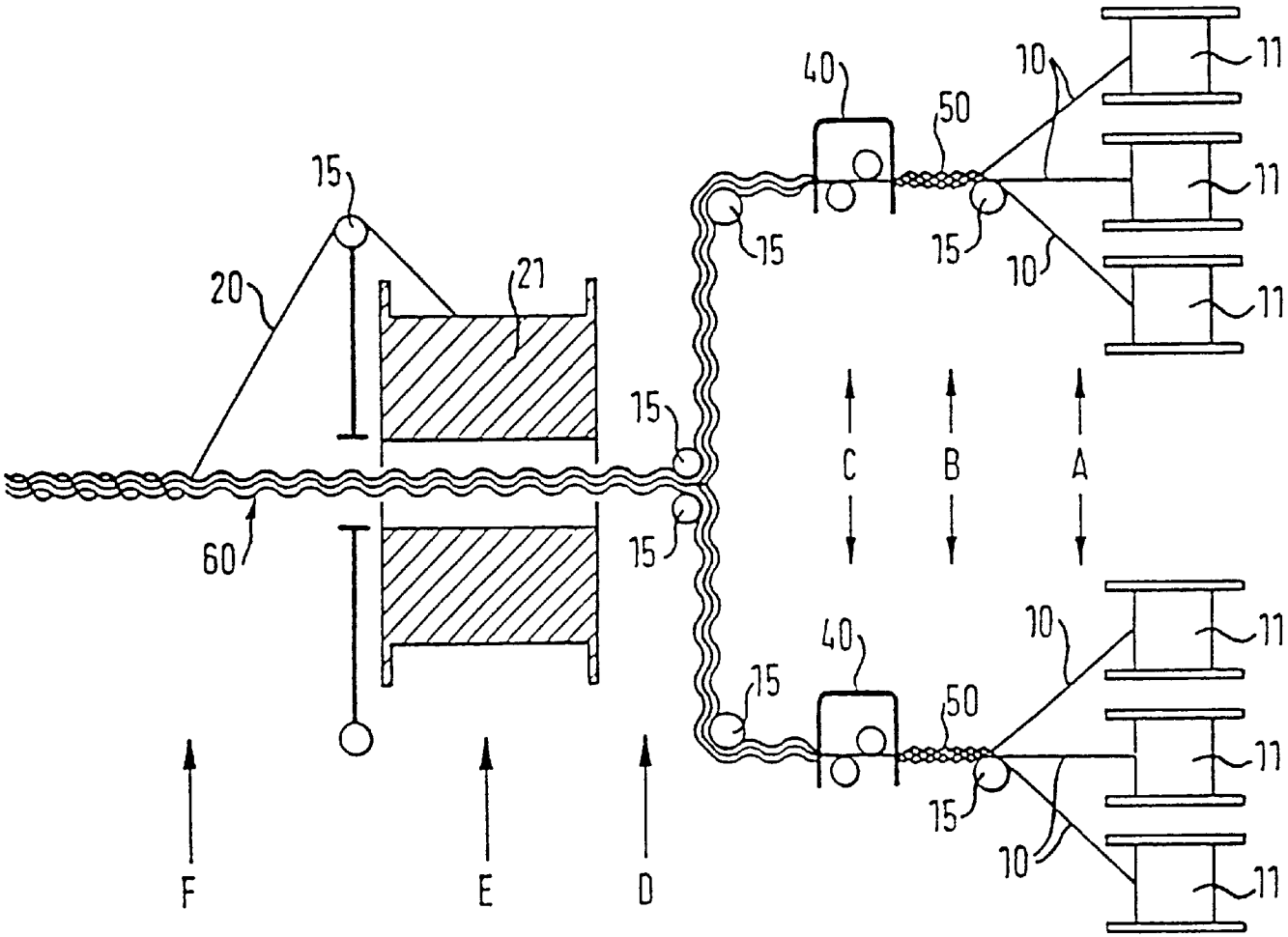
FIG. 1 is a schematic illustration of the process in accordance with the invention for producing a steel cord in accordance with the invention as shown in FIG. 4.

Referring now to FIG. 1 there is illustrated schematically a process in accordance with the invention for producing a steel cord in accordance with the invention as shown in FIG. 4. To produce this steel cord having a core bunch of six wire filaments the core filaments 10 are uncoiled from six reels 11 in a first step A in the operation. In a further step B three each of the six wire filaments 10 are combined into a strand 50 by means of deflection sheaves 15 to be then spirally preshaped in a third step in the operation C by two false twisters 40 each right-handedly with a set pitch (in this case 18 mm) In a further step in the operation D after having left the false twisters 40 the two bunches of three wire filaments each are combined into a bunch of wires comprising six wire filaments, forming the core 60 of the steel cord to be produced. The core 60 of six core filaments 10, formed on a right-handed spiral, is surrounded in the same operation with a sheathing wire 20 which is uncoiled in step E from a reel 21 and is wound around the core 60 right-handedly with a prescribed pitch (for example 18 mm) in step F of the operation. The result of this production process is a steel cord in accordance with the invention, as depicted in FIG. 4, which incorporates left-handed core filaments 10 and sheathing wires 20 as shown in FIG. 4, likewise as the steel cord shown in FIG. 3.

The wire filaments used in this production process are advantageously made of rolled wire having a steel quality of 0.6 to 0.9% C, 0.4 to 0.8% Mn and 0.1 to 0.3% Si as well as max. 0.03% S, P and further accompanying elements as usual. In the upstream zone the rolled wire is rolled in several stages from 5.5 mm to thinner diameters, drawn, heat-treated and—prior to the subsequent last stage, mostly a wet drawing stage—brassed. The brass is exploited as a "lubricant " in drawing, it serving, however, primarily to enhance the bond of the steel cord to the rubber blend of the tire. Producing the steel cord is done by twisting and stranding the wire filaments in suitable number and shape, the choice of machine parameters needing to be found from a suitable combination of reel size and machine speed since a high speed calls for small working reels and correspondingly a low speed calls for large working reels.

The process as illustrated in accordance with the invention for producing a steel cord is suitable for producing steel cords incorporating core bunches of two to thirty wire filaments, although cord designs of the same kind incorporating more than thirty wire filaments are also conceivable.

Figure 2:
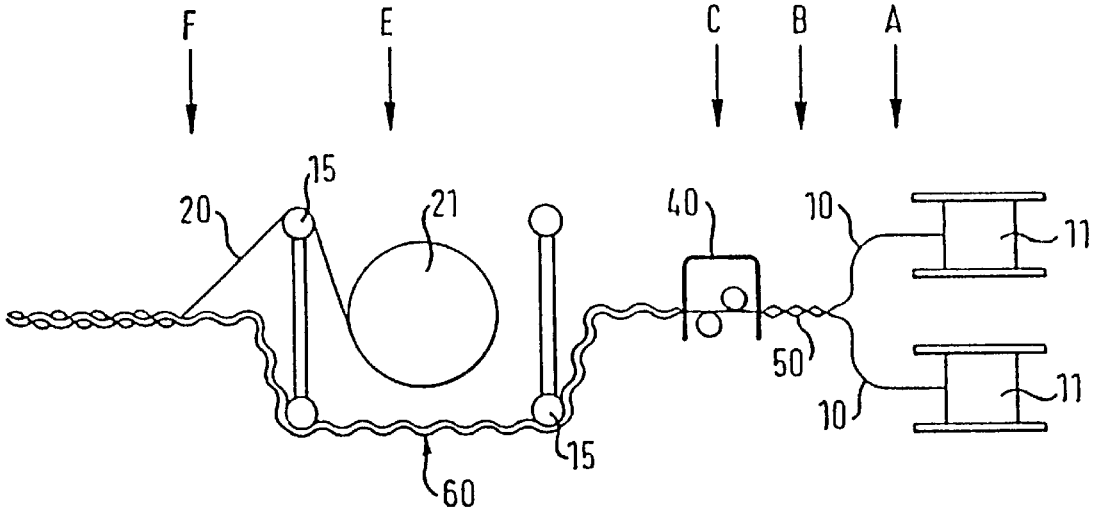
FIG. 2 is a schematic illustration of the process in accordance with the invention for producing a steel cord in accordance with the invention as shown in FIG. 3.

Referring now to FIG. 2 there is illustrated a process for producing a steel cord in accordance with the invention as shown in FIG. 3. In a first step A in the operation two wire filaments 10 are uncoiled from two reels 11 and combined in a second step B. The two wire filaments 10 are shaped into a right-handed spiral in a further step C in the operation in a false twister 40 right-handedly at a set pitch (for example 14 mm). These two spirally intertwined wire filaments 10 form the core 60 of the steel cord to be produced. In a next step E in the operation a third wire filament is uncoiled from a reel 21 which as the sheathing wire 20 is wound around the core 60 right-handedly with pitch of e.g. 14 mm in a last step F in the operation.

In a further aspect of the invention the steel cords in accordance with the invention as described above are pressed into an oval shape, this being particularly suitable in the case of steel cords as shown in FIGS. 5 and 6. The oval shape of the steel cord may be obtained, for example, by squeezing the cord through a pair of rolls. Due to the difference in stiffness radially and laterally the oval shape of the steel cord offers considerable advantages when put to use in a tire.

The steel cord as proposed in accordance with the invention is simple and cost-effective in production and features excellent properties especially as regards compressive stressing. It is easily rubberized since the residual torsional stresses are cancelled outwardly and it thus remains flat during rubberizing. Migration of the employed wire filaments from the core composite when used as belting is also very slight. By means of the embodiments as proposed in accordance with the invention a plurality of steel cord designs can be produced, covering a broad range of applications, starting from steel cords for car tires via van tires up to tires for heavy trucks and buses.

What is claimed is:

1. A process of producing a steel cord, said process comprising the following steps:

A: uncoiling from reels (11) at least two wire filaments serving as core filaments (10), B: combining said uncoiled core filaments (10) into a strand (50) and initially intertwining the core filaments in a false twister (40) so as to spirally preshape the filaments, and C: at a position located downstream of said false twister (40), sheathing said spirally preshaped individual filaments (10) juxtaposed in parallel in the form of a core (60) with at least one wire filament serving as at least one sheathing wire (20) uncoiled from a reel (21).

2. The process as set forth in claim 1, wherein in step B two, three or four core filaments (10) are mutually intertwined and in that two or more strands (50) incorporating two, three or four intertwined core filaments (10) are combined into a core (60) in step C.

3. The process as set forth in claim 1, wherein said at least two core filaments (10) are intertwined left-handedly or right-handedly and in that said at least one sheathing wire (20) is likewise wound left-handedly or right-handedly about said preshaped core filaments (10).

4. A process for producing a steel cord, comprising compressing a steel cords, produced as set forth in claim 1, such that the steel cord receives an oval shape.

5. The process as set forth in claim 4, wherein said steel cord is compressed into an oval shape through a pair of rolls.

6. A steel cord produced by a process according to claim 1, wherein the pitch of the spiral preshape of said core filaments (10) corresponds to the pitch of said sheathing wire (20) surrounding the core filaments.

7. The steel cord as set forth in claim 6, wherein said at least two core filaments (10) are shaped as right-handed or left-handed spirals and said at least one sheathing wire (20) surrounds said at least two core filaments (10) likewise right-handedly or left-handedly.

8. The steel cord as set forth in claim 6, wherein the diameter of said core filaments (10) is between 0.12 and 0.5 mm.

9. The steel cord as set forth in claim 6, wherein one or more plies of said at least one sheathing wire (20) are provided surrounding said at least two core filaments (10).

10. The steel cord as set forth in claim 6, wherein said core filaments (10) and said sheathing wires (20) are the same in diameter.

11. A steel cord produced by a process according to claim 1, wherein the pitch of said spirally preshaped filaments and the pitch of said surrounding sheathing wire (20) is between 6 mm and 30 mm.

12. The steel cord as set forth in claim 11, wherein the diameter of said core filaments (10) is between 0.12 and 0.5 mm.

13. A steel cord produced by a process according to claim 1, wherein the outer diameter of the spirals of each preshaped core filament (10) is between 0.1 and 0.5 mm.

14. A steel cord produced by a process according to claim 1, wherein said core filaments (10) and said sheathing wires (20) differ in diameter.

15. A steel cord produced by a process according to claim 1, wherein a spiral wire (30) surrounding said sheathing wires (20) is provided.

16. A steel cord produced by a process according to claim 1, wherein said at least two core filaments (10) forming a core (60) are oriented juxtaposed in parallel and feature elastic residual torsional stresses which are cancelled in conjunction with the restoring forces of at least one sheathing wire (20) surrounding the core filaments (10).

17. The steel cord as set forth in claim 16, wherein the elastic residual torsional stresses are generated by a false twister (40).

18. A steel cord produced by a process according to claim 1, wherein said steel cord features a flattened, substantially oval shape.

19. The steel cord as set forth in claim 18, wherein the ratio of width to height of said flattened steel cord is 1.15 to 1.50.

20. A process of producing a steel cord, said process comprising the following steps:

A: uncoiling from reels (11) at least two wire filaments serving as core filaments (10), B: combining said uncoiled core filaments into a strand (50) and intertwining the core filaments in a false twister (40) to form intertwined core filaments so as to spirally preshape the core filaments, C: untwining said intertwined core filaments in the false twister, and D: at a position located downstream of said false twister, sheathing said spirally preshaped core filaments juxtaposed in parallel in the form of a core (60) with at least one wire filament serving as at least one sheathing wire (20) uncoiled from a reel (21).

* * * * *